US010087724B2

(12) United States Patent
Ritchey

(10) Patent No.: US 10,087,724 B2
(45) Date of Patent: Oct. 2, 2018

(54) GRAVEL PACK MANIFOLD AND ASSOCIATED SYSTEMS AND METHODS

(71) Applicant: WEATHERFORD TECHNOLOGY HOLDINGS, LLC, Houston, TX (US)

(72) Inventor: Brian J. Ritchey, Hockley, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 283 days.

(21) Appl. No.: 14/992,638

(22) Filed: Jan. 11, 2016

(65) Prior Publication Data

US 2017/0198556 A1 Jul. 13, 2017

(51) Int. Cl.
*E21B 43/04* (2006.01)
*E21B 43/08* (2006.01)

(52) U.S. Cl.
CPC ..... *E21B 43/04* (2013.01); *E21B 43/08* (2013.01)

(58) Field of Classification Search
CPC ..... E21B 43/04; E21B 43/08; E21B 43/045
See application file for complete search history.

(56) References Cited

U.S. PATENT DOCUMENTS 2,140,072 A * 12/1938 Chenault ..... E21B 43/04 166/114
2,349,062 A * 5/1944 Uren ..... E21B 43/04 166/114
2,727,575 A * 12/1955 Abendroth ..... E21B 43/04 166/131
3,126,963 A * 3/1964 Graham ..... E21B 34/12 166/51
4,932,474 A * 6/1990 Schroeder, Jr. ..... E21B 43/045 166/278
5,409,061 A 4/1995 Bullick
5,505,260 A * 4/1996 Andersen ..... E21B 17/1014 166/100
6,148,915 A 11/2000 Mullen et al.
6,230,801 B1 5/2001 Hill, Jr. et al.
(Continued)

FOREIGN PATENT DOCUMENTS

GB 2167473 A * 5/1986 ..... E21B 23/08

OTHER PUBLICATIONS

International Search Report with Written Opinion dated Apr. 14, 2017 for PCT Patent Application No. PCT/US17/012275, 19 pages.

*Primary Examiner* — James G Sayre
(74) *Attorney, Agent, or Firm* — Smith IP Services, P.C.

(57) ABSTRACT

A gravel pack system can include a manifold having at least three flow passages isolated from each other, with each of the passages intersecting a same lateral cross-section. A method can include displacing a service string, thereby controlling flow through ports that provide communication with a manifold exterior, the manifold including at least three flow passages, one port providing communication between one passage and the manifold exterior, and another port providing communication between another passage and the manifold exterior, and in one position of the service string, the one passage is in communication with a well annulus via another port providing communication with the manifold exterior, and the one passage is in communication with another well annulus via the one port, the annuli being isolated from each other by a packer, and the other port is in a seal bore and disposed longitudinally between the other ports.

33 Claims, 8 Drawing Sheets

(56) References Cited

U.S. PATENT DOCUMENTS

| | | | | |
|---|---|---|---|---|
| 6,571,875 | B2 | 6/2003 | Bissonnette et al. | |
| 6,702,020 | B2 * | 3/2004 | Zachman | E21B 34/14 166/278 |
| 6,725,929 | B2 | 4/2004 | Bissonnette et al. | |
| 6,789,623 | B2 | 9/2004 | Hill, Jr. et al. | |
| 6,981,551 | B2 | 1/2006 | Turner et al. | |
| 7,017,664 | B2 | 3/2006 | Walker et al. | |
| 7,128,151 | B2 | 10/2006 | Corbett | |
| 7,210,527 | B2 | 5/2007 | Walker et al. | |
| 7,290,610 | B2 * | 11/2007 | Corbett | E21B 34/06 166/278 |
| 7,451,816 | B2 * | 11/2008 | Corbett | E21B 34/06 166/278 |
| 7,472,750 | B2 | 1/2009 | Walker et al. | |
| 7,987,909 | B2 * | 8/2011 | Pineda | E21B 34/14 166/235 |
| 2002/0096328 | A1 | 7/2002 | Echols et al. | |
| 2002/0195253 | A1 * | 12/2002 | Hill, Jr. | E21B 21/10 166/380 |
| 2003/0000702 | A1 * | 1/2003 | Streich | E21B 34/06 166/278 |
| 2004/0069489 | A1 | 4/2004 | Corbett | |
| 2004/0221988 | A1 * | 11/2004 | McGregor | E21B 43/04 166/278 |
| 2008/0099194 | A1 | 5/2008 | Clem | |
| 2008/0283252 | A1 * | 11/2008 | Guignard | E21B 33/124 166/381 |

* cited by examiner

GRAVEL PACK MANIFOLD AND ASSOCIATED SYSTEMS AND METHODS

BACKGROUND

This disclosure relates generally to equipment and operations utilized in conjunction with subterranean wells and, in an example described below, more particularly provides a gravel pack manifold and associated systems and methods.

Although variations are possible, a gravel pack is generally an accumulation of "gravel" (typically sand, proppant or another granular or particulate material, whether naturally occurring or synthetic) about a tubular filter or screen in a wellbore. The gravel is sized, so that it will not pass through the screen, and so that sand, debris and fines from an earth formation penetrated by the wellbore will not easily pass through the gravel pack with fluid flowing from the formation. Although relatively uncommon, a gravel pack may also be used in an injection well, for example, to support an unconsolidated formation.

Placing the gravel about the screen in the wellbore is a complicated process, requiring relatively sophisticated equipment and techniques to maintain well integrity while ensuring the gravel is properly placed in a manner that provides for subsequent efficient and trouble-free operation. It will, therefore, be readily appreciated that improvements are continually needed in the arts of designing and utilizing gravel pack equipment and methods. Such improved equipment and methods may be useful with any type of gravel pack in cased or open wellbores, and in vertical, horizontal or deviated well sections.

DETAILED DESCRIPTION

Figure 1:
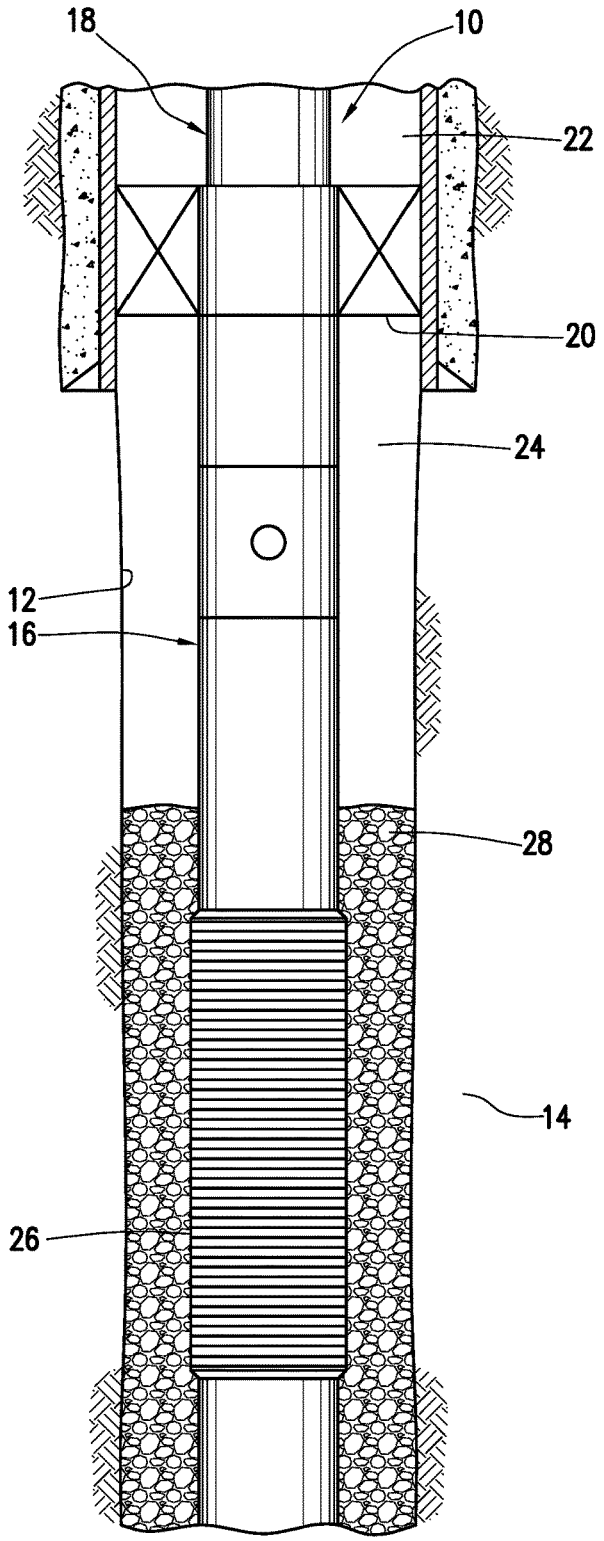
FIG. 1 is a representative partially cross-sectional view of an example of a gravel pack system and associated method which can embody principles of this disclosure.

Representatively illustrated in FIG. 1 is a gravel pack system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 has been drilled, so that it penetrates an earth formation 14. A well completion assembly 16 is installed in the wellbore 12, for example, using a generally tubular service string 18 to convey the completion assembly and set a packer 20 of the completion assembly.

Setting the packer 20 in the wellbore 12 provides for isolation of an upper well annulus 22 from a lower well annulus 24 (although, as described above, at the time the packer is set, the upper annulus and lower annulus may be in communication with each other). The upper annulus 22 is formed radially between the service string 18 and the wellbore 12, and the lower annulus 24 is formed radially between the completion assembly 16 and the wellbore.

The terms "upper" and "lower" are used herein for convenience in describing the relative orientations of the annulus 22 and annulus 24 as they are depicted in FIG. 1. In other examples, the wellbore 12 could be horizontal (in which case neither of the annuli would be above or below the other) or otherwise deviated. Thus, the scope of this disclosure is not limited to any relative orientations of examples as described herein.

As depicted in FIG. 1, the packer 20 is set in a cased portion of the wellbore 12, and a generally tubular well screen 26 of the completion assembly 16 is positioned in an uncased or open hole portion of the wellbore. However, in other examples, the packer 20 could be set in an open hole portion of the wellbore 12, and/or the screen 26 could be positioned in a cased portion of the wellbore. Thus, it will be appreciated that the scope of this disclosure is not limited to any particular details of the system 10 as depicted in FIG. 1, or as described herein.

In the FIG. 1 method, the service string 18 not only facilitates setting of the packer 20, but also provides a variety of flow passages for directing fluids to flow into and out of the completion assembly 16, the upper annulus 22 and the lower annulus 24. One reason for this flow directing function of the service string 18 is to deposit gravel 28 in the lower annulus 24 about the well screen 26.

Examples of some steps of the method are representatively depicted in FIGS. 2-7 and are described more fully below. However, it should be clearly understood that it is not necessary for all of the steps depicted in FIGS. 2-7 to be performed, and additional or other steps may be performed, in keeping with the principles of this disclosure.

Figure 2:
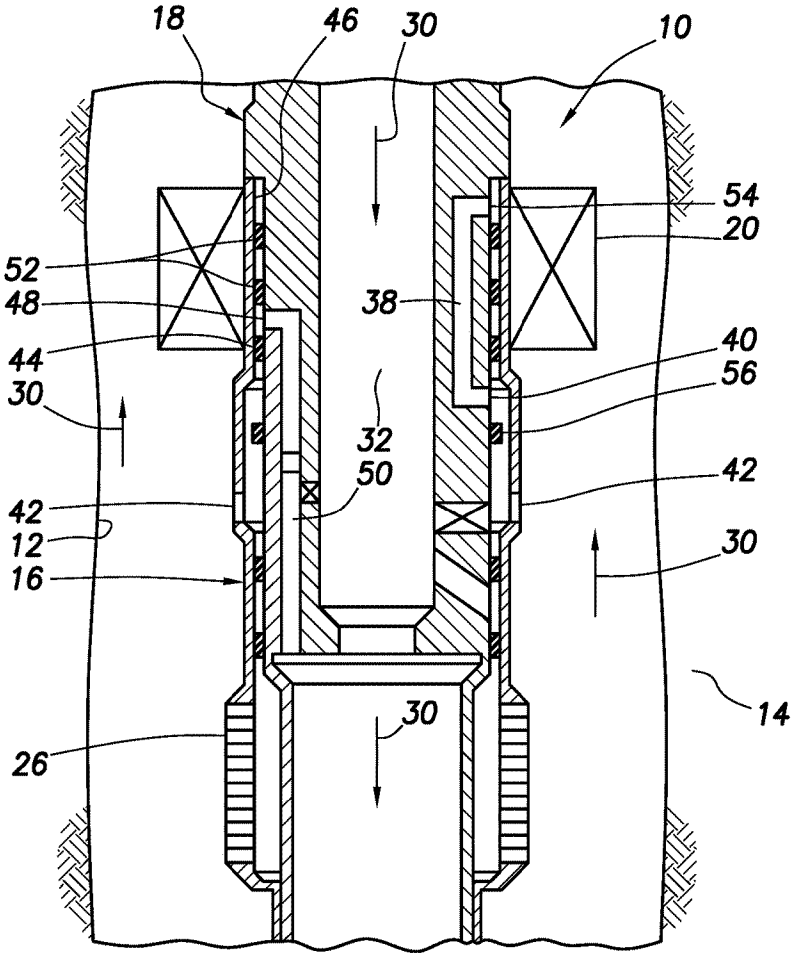

Referring now to FIG. 2, the system 10 is depicted as the service string 18 is being used to convey and position the completion assembly 16 in the wellbore 12. For clarity of illustration, the cased portion of the wellbore 12 is not depicted in FIGS. 2-7.

Note that, as shown in FIG. 2, the packer 20 is not yet set, and so the completion assembly 16 can be displaced through the wellbore 12 to any desired location. As the completion assembly 16 is displaced into the wellbore 12 and positioned therein, a fluid 30 can be circulated through a flow passage 32 that extends longitudinally through the service string 18.

Figure 3:
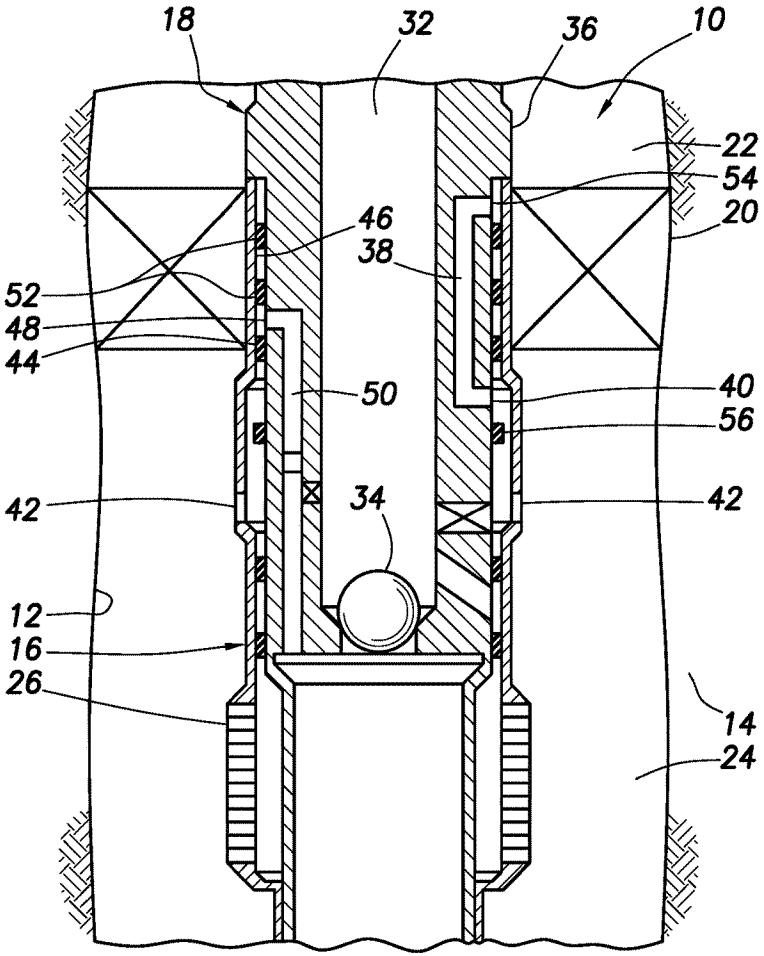
FIGS. 2-7 are representative cross-sectional views of a succession of steps in the method of gravel packing.

As depicted in FIG. 3, the completion assembly 16 has been appropriately positioned in the wellbore 12, and the packer 20 has been set to thereby provide for isolation between the upper annulus 22 and the lower annulus 24. In this example, to accomplish setting of the packer 20, a ball, dart or other plug 34 is deposited in the flow passage 32 and, after the plug 34 seals off the flow passage, pressure in the flow passage above the plug is increased.

This increased pressure operates a packer setting tool 36 of the service string 18. The setting tool 36 can be of the type well known to those skilled in the art, and so further details of the setting tool and its operation are not illustrated in the drawings or described herein.

Although the packer 20 in this example is set by application of increased pressure to the setting tool 36 of the service string 18, in other examples the packer may be set using other techniques. For example, the packer 20 could be set by manipulation of the service string 18 (e.g., rotating in a selected direction and then setting down or pulling up, etc.), with or without application of increased pressure. Thus, the scope of this disclosure is not limited to any particular technique for setting the packer 20.

Note that, although the set packer 20 separates the upper annulus 22 from the lower annulus 24, in the step of the method as depicted in FIG. 3, the upper annulus and lower annulus are not yet fully isolated from each other. Instead, another flow passage 38 in the service string 18 provides for fluid communication between the upper annulus 22 and the lower annulus 24.

In FIG. 3, it may be seen that a lower port 40 permits communication between the flow passage 38 and an interior of the completion assembly 16. Openings 42 formed through the completion assembly 16 permit communication between the interior of the completion assembly and the lower annulus 24.

An annular seal 44 is sealingly received in a seal bore 46. The seal bore 46 is located within the packer 20 in this example, but in other examples, the seal bore could be otherwise located (e.g., above or below the packer).

In the step as depicted in FIG. 3, the seal 44 isolates the port 40 from another port 48 that provides communication between another flow passage 50 and an exterior of the service string 18. At this stage of the method, no flow is permitted through the port 48, because one or more additional annular seals 52 on an opposite longitudinal side of the port 48 are also sealingly received in the seal bore 46.

An upper end of the flow passage 38 is in communication with the upper annulus 22 via an upper port 54. Although not clearly visible in FIG. 3, relatively small annular spaces between the setting tool 36 and the packer 20 provide for communication between the port 54 and the upper annulus 22.

Thus, it will be appreciated that the flow passage 38 and ports 40, 54 effectively bypass the seal bore 46 (which is engaged by the annular seals 44, 52 carried on the service string 18) and allow for hydrostatic pressure in the upper annulus 22 to be communicated to the lower annulus 24. This enhances wellbore 12 stability, in part by preventing pressure in the lower annulus 24 from decreasing (e.g., toward pressure in the formation 14) when the packer 20 is set.

Figure 4:
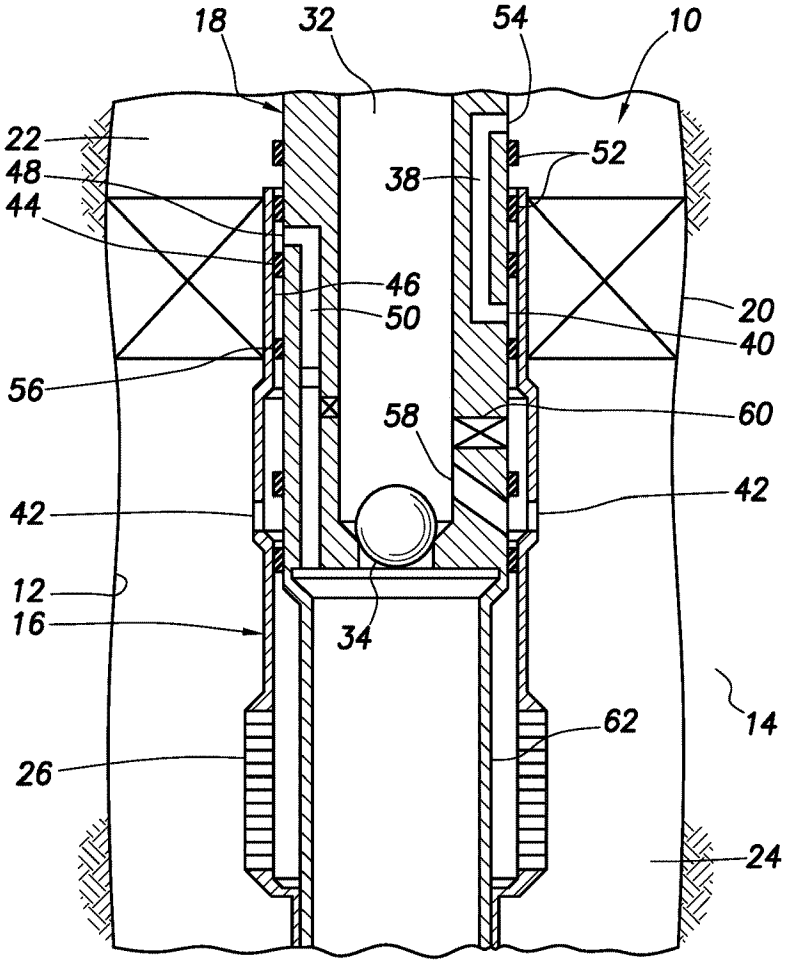

As depicted in FIG. 4, the service string 18 has been raised relative to the completion string 16, which is now secured to the wellbore 12 due to previous setting of the packer 20. In this position, another annular seal 56 carried on the service string 18 is now sealingly engaged in the seal bore 46, thereby isolating the flow passage 38 from the lower annulus 24.

However, the flow passage 32 is now in communication with the lower annulus 24 via the openings 42 and one or more ports 58 in the service string 18. Thus, hydrostatic pressure continues to be communicated to the lower annulus 24.

The lower annulus 24 is isolated from the upper annulus 22 by the packer 20. The flow passage 38 is not in communication with the lower annulus 24 due to the annular seal 56 in the seal bore 46. The flow passage 50 may be in communication with the lower annulus 24, but no flow is permitted through the port 48 due to the annular seal 52 in the seal bore 46. Thus, the lower annulus 24 is isolated completely from the upper annulus 22.

In the FIG. 4 position of the service string 18, the packer 20 can be tested by applying increased pressure to the upper annulus 22 (for example, using surface pumps). If there is any leakage from the upper annulus 22 to the lower annulus 24, this leakage will be transmitted via the openings 42 and ports 58 to surface via the flow passage 32, so it will be apparent to operators at surface and remedial actions can be taken.

Figure 5:
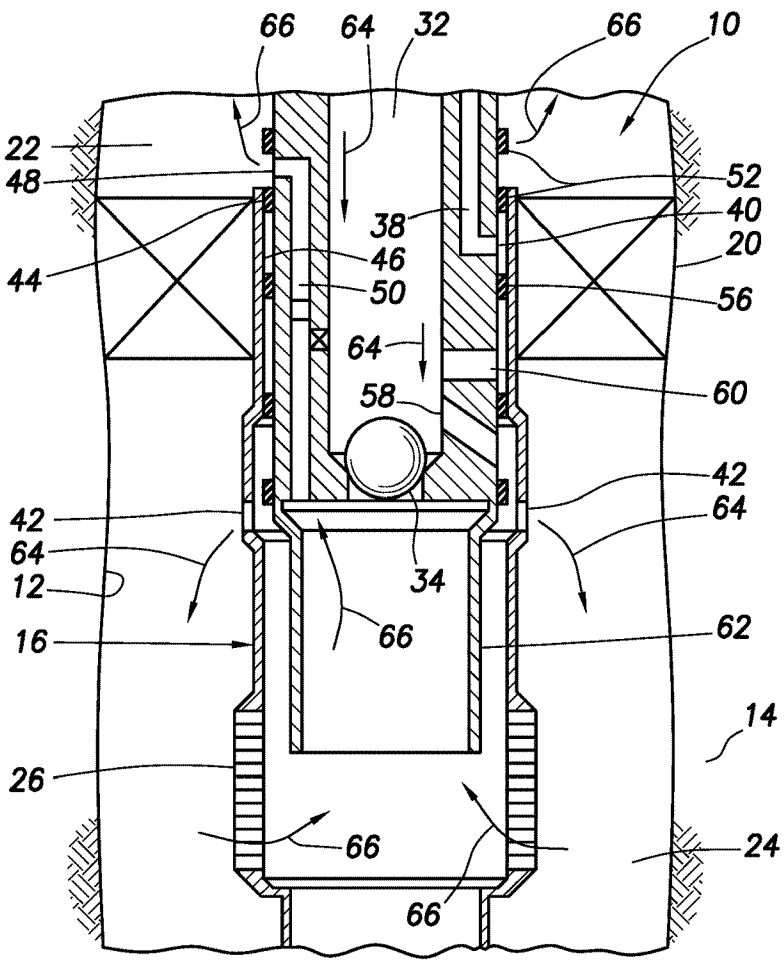

As depicted in FIG. 5, a reversing valve 60 has been opened by raising the service string 18 relative to the completion assembly 16, so that the annular seal 56 is above the seal bore 46, and then applying pressure to the upper annulus 22 to open the reversing valve. The service string 18 is then lowered to its FIG. 5 position (which is raised somewhat relative to its FIG. 4 position).

Thus, in this example, the reversing valve 60 is an annular pressure-operated sliding sleeve valve of the type well known to those skilled in the art, and so operation and construction of the reversing valve is not described or illustrated in more detail by this disclosure. However, it should be clearly understood that the scope of this disclosure is not limited to use of any particular type of reversing valve, or to any particular technique for operating a reversing valve.

The raising of the service string 18 relative to the completion assembly 16 can facilitate operations other than opening of the reversing valve 60. In this example, the raising of the service string 18 can function to prepare an isolation valve (not shown) connected in or below a washpipe 62 of the service string for later closing.

The isolation valve can be of the type well known to those skilled in the art, and which can (when closed) prevent flow from the flow passage 32 into an interior of the well screen 26. However, the scope of this disclosure is not limited to use of any particular type of isolation valve, or to any particular technique for operating an isolation valve.

In the FIG. 5 position, the flow passage 32 is in communication with the lower annulus 24 via the openings 42 and ports 58. In addition, the flow passage 50 is in communication with the upper annulus 22 via the port 48. The flow passage 50 is also in communication with an interior of the well screen 26 via the washpipe 62.

A gravel slurry 64 (a mixture of the gravel 28 and one or more fluids 66) can now be flowed from surface through the flow passage 32 of the service string 18, and outward into the lower annulus 24 via the openings 42 and ports 58. The fluids 66 can flow inward through the well screen 26, into the washpipe 62, and to the upper annulus 22 via the flow passage 50 for return to surface. In this manner, the gravel 28 is deposited into the lower annulus 24 (see FIGS. 6 & 7).

Figure 6:
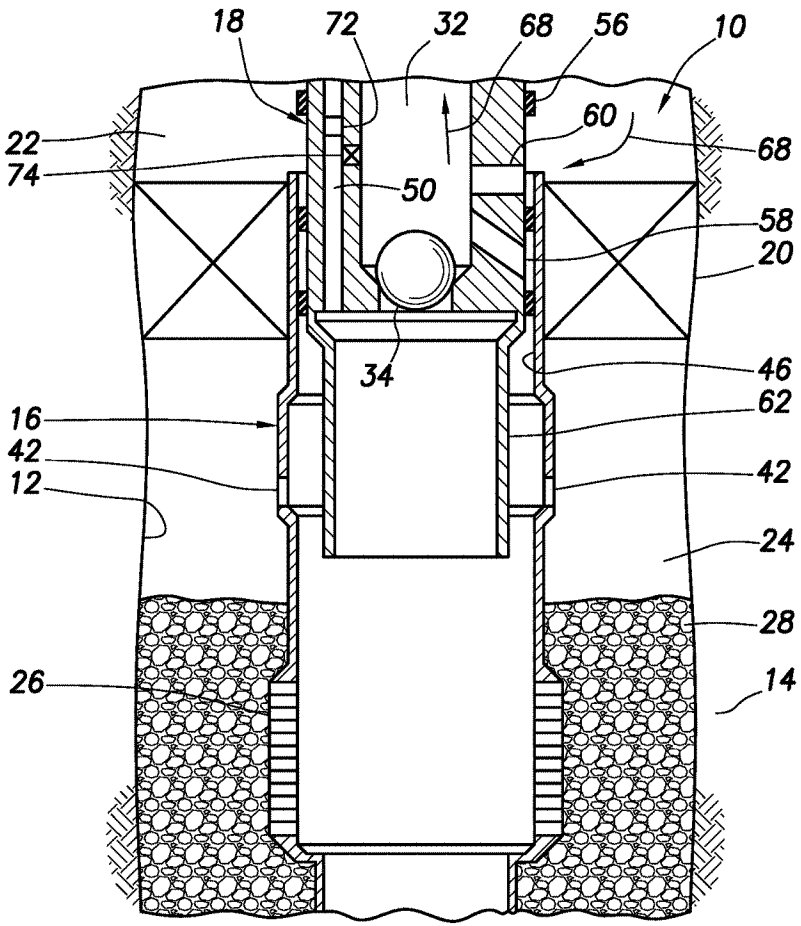

As depicted in FIG. 6, the service string 18 has been raised further relative to the completion assembly 16 after the gravel slurry 64 pumping operation is concluded. The annular seal 56 is now out of the seal bore 46, thereby exposing the reversing valve 60 again to the upper annulus 22.

A clean fluid 68 can now be circulated from surface via the upper annulus 22 and inward through the open reversing valve 60, and then back to surface via the flow passage 32. This reverse circulating flow can be used to remove any gravel 28 remaining in the flow passage 32 after the gravel slurry 64 pumping operation.

After reverse circulating, the service string 18 can be conveniently retrieved to surface and a production tubing string (not shown) can be installed. Flow through the openings 42 is prevented when the service string 18 is withdrawn from the completion assembly 16 (e.g., by shifting a sleeve of the type known to those skilled in the art as a closing sleeve). A lower end of the production tubing string can be equipped with annular seals and stabbed into the seal bore 46, after which fluids can be produced from the formation 14 through the gravel 28, then into the well screen 26 and to surface via the production tubing string.

Figure 7:
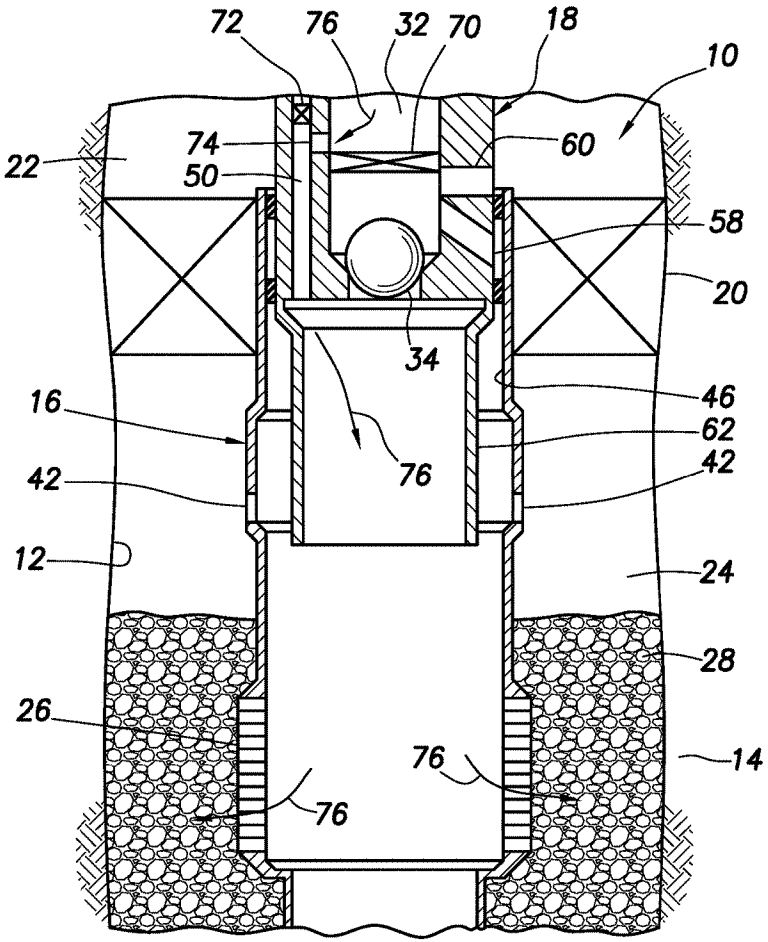

An optional treatment step is depicted in FIG. 7. This treatment step can be performed after the reverse circulating step of FIG. 6, and before retrieval of the service string 18.

As depicted in FIG. 7, another ball, dart or other plug 70 is installed in the flow passage 32, and then increased pressure is applied to the flow passage. This increased pressure causes a lower portion of the flow passage 50 to be isolated from an upper portion of the flow passage (e.g., by closing a valve 72), and also causes the lower portion of the flow passage 50 to be placed in communication with the flow passage 32 above the plug 70 (e.g., by opening a valve 74).

The lower portion of the flow passage 50 is, thus, now isolated from the upper annulus 22. However, the lower portion of the flow passage 50 now provides for communication between the flow passage 32 and the interior of the well screen 26 via the washpipe 62. Note, also, that the lower annulus 24 is isolated from the upper annulus 22.

A treatment fluid 76 can now be flowed from surface via the flow passages 32, 50 and washpipe 62 to the interior of the well screen 26, and thence outward through the well screen into the gravel 28. If desired, the treatment fluid 76 can further be flowed into the formation 14.

The treatment fluid 76 could be any type of fluid suitable for treating the well screen 26, gravel 28, wellbore 12 and/or formation 14. For example, the treatment fluid 76 could comprise an acid for dissolving a mud cake (not shown) on a wall of the wellbore 12, or for dissolving contaminants deposited on the well screen 26 or in the gravel 28. Acid may be flowed into the formation 14 for increasing its permeability. Conformance agents may be flowed into the formation 14 for modifying its wettability or other characteristics. Breakers may be flowed into the formation 14 for breaking down gels used in a previous fracturing operation. Thus, it will be appreciated that the scope of this disclosure is not limited to use of any particular treatment fluid, or to any particular purpose for flowing treatment fluid into the completion assembly 16.

Figure 8:
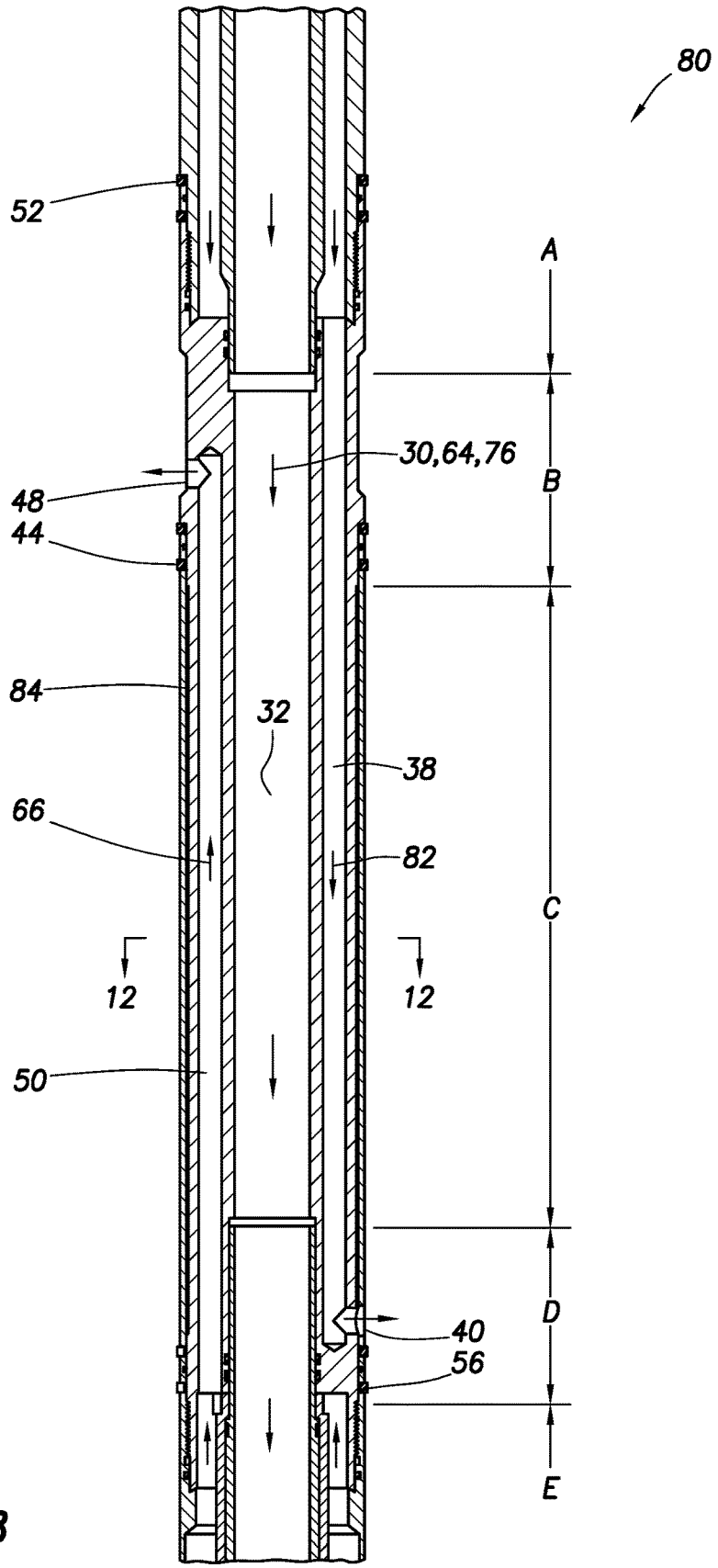
FIG. 8 is a representative enlarged scale cross-sectional view of a manifold which may be used in the system and method of FIGS. 1-7.

Referring additionally now to FIG. 8, a manifold 80 of the service string 18 is representatively illustrated, apart from the remainder of the service string and system 10. The term "manifold" is used for this portion of the service string 18, because it comprises a structure having a variety of flow passages 32, 38, 50 therein for directing flow as desired in the system 10.

In the FIG. 8 example, the flow passages 32, 38, 50 all extend longitudinally in the manifold 80. The flow passage 32 extends completely through the manifold 80. The flow passages 38, 50 each extend partially through the manifold 80.

Note that the flow passages 32, 38, 50 are isolated from each other in the manifold 80. The ports 40, 54 (see FIGS. 2-4) provide communication between the flow passage 38 and an exterior of the manifold 80, and the port 48 provides communication between the flow passage 50 and the exterior of the manifold. Thus, each of the flow passages 32, 38, 50 can be externally placed in communication with selected ones of the other flow passages, depending, for example, on the position of the service string 18 relative to the completion string 16 (and the seals 44, 52, 56 relative to the seal bore 46).

For convenience of description, the manifold 80 example of FIG. 8 can be divided conceptually into five successive contiguous sections A-E. The upper section A has the flow passages 32, 38 formed therein and these flow passages are isolated from each other, but the flow passage 50 is not present in this section. The flow passage 38 is in communication with the exterior of the manifold 80 via the port 54 (not visible in FIG. 8, see FIGS. 2-4).

In the next section B, all of the flow passages 32, 38, 50 are formed in the manifold 80. The flow passage 50 is in communication with the exterior of the manifold 80 via the port 48. The flow passages 32, 38 are isolated from each other, and from the exterior of the manifold 80.

In the next section C, all of the flow passages 32, 38, 50 are formed in the manifold 80. The flow passages 32, 38, 50 are isolated from each other, and from the exterior of the manifold 80.

In the next section D, all of the flow passages are formed in the manifold 80. The flow passage 38 is in communication with the exterior of the manifold 80 via the port 40.

In the lower section E, the flow passages 32, 50 are formed in the manifold 80 and are isolated from each other. The flow passage 38 is not present in this section.

Although as depicted in FIG. 8, the flow passages 32, 38, 50 are straight and extend directly longitudinally in the manifold 80, in other examples the flow passages could have deviations, curves, corners, different shapes, etc. Thus, the scope of this disclosure is not limited to any particular shape, orientation or configuration of the flow passages 32, 38, 50 in the manifold 80.

Also depicted in FIG. 8 are the various flows described above for the method steps example of FIGS. 2-7. Although these flows are illustrated in the same FIG. 8, they do not necessarily occur simultaneously.

Arrows in the flow passage 32 represent the fluid 30 circulated in FIG. 2, the gravel slurry 64 of FIG. 5, and the treatment fluid 76 of FIG. 7. The fluid 68 reverse circulated in FIG. 6 would flow in an opposite direction through the flow passage 32.

Arrows 82 in the flow passage 38 represent communication of hydrostatic pressure from the upper annulus 22 to the lower annulus 24, as depicted in FIG. 3. The slurry fluid 66 flows through the flow passage 50 in the gravel packing operation, as depicted in FIG. 5.

As mentioned above, all of the flow passages 32, 38, 50 are present in sections B-D of the manifold 80. By providing these flow passages 32, 38, 50 in this longitudinally "overlapping" manner, a length of the service string 18 and, consequently, a length of the completion assembly 16 can be reduced. This produces numerous benefits, including (but not limited to) reduction in costs to manufacture the completion assembly 16 and service string 18, reduction in transportation costs (e.g., costs for transporting over-sized components), reduced installation time, convenience in handling, reduced manipulation of the service string, etc. However, it should be clearly understood that the scope of this disclosure is not limited to obtaining any particular benefits from the construction of the manifold 80 as depicted in the FIG. 8 example.

Figure 11:
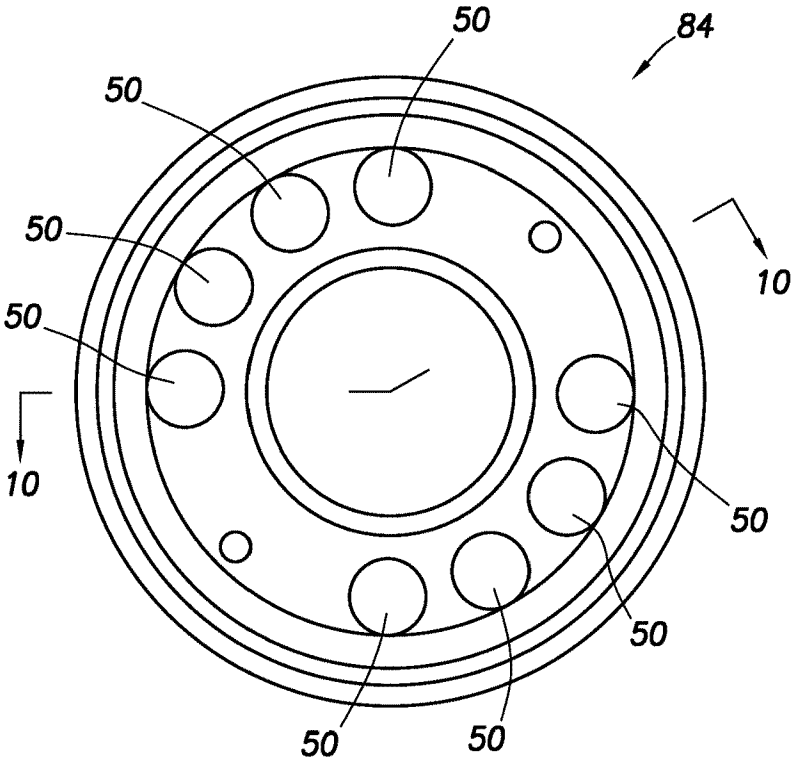
FIG. 11 is a representative bottom view of the three-way sub.
Figure 9:
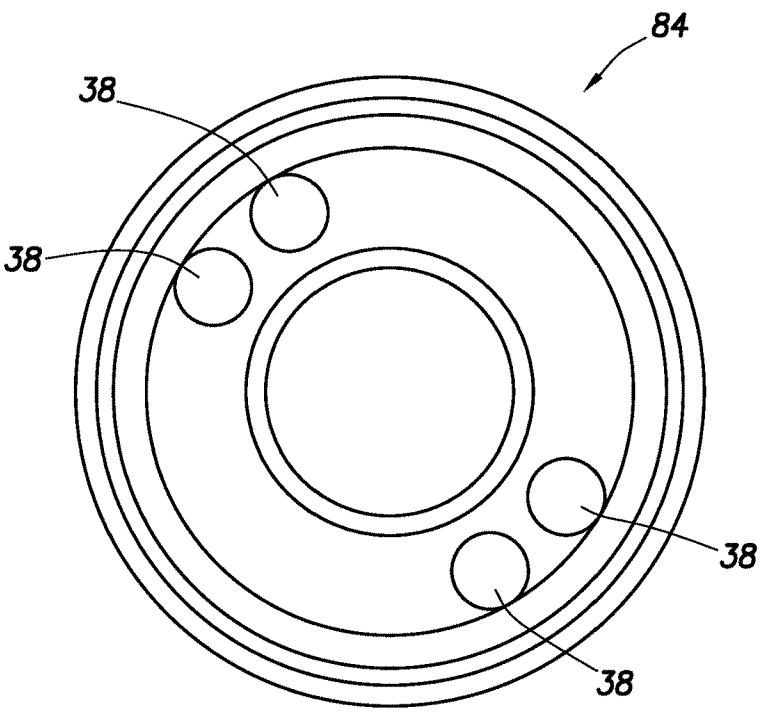
FIG. 9 is a representative top view of a three-way sub of the manifold.
Figure 10:
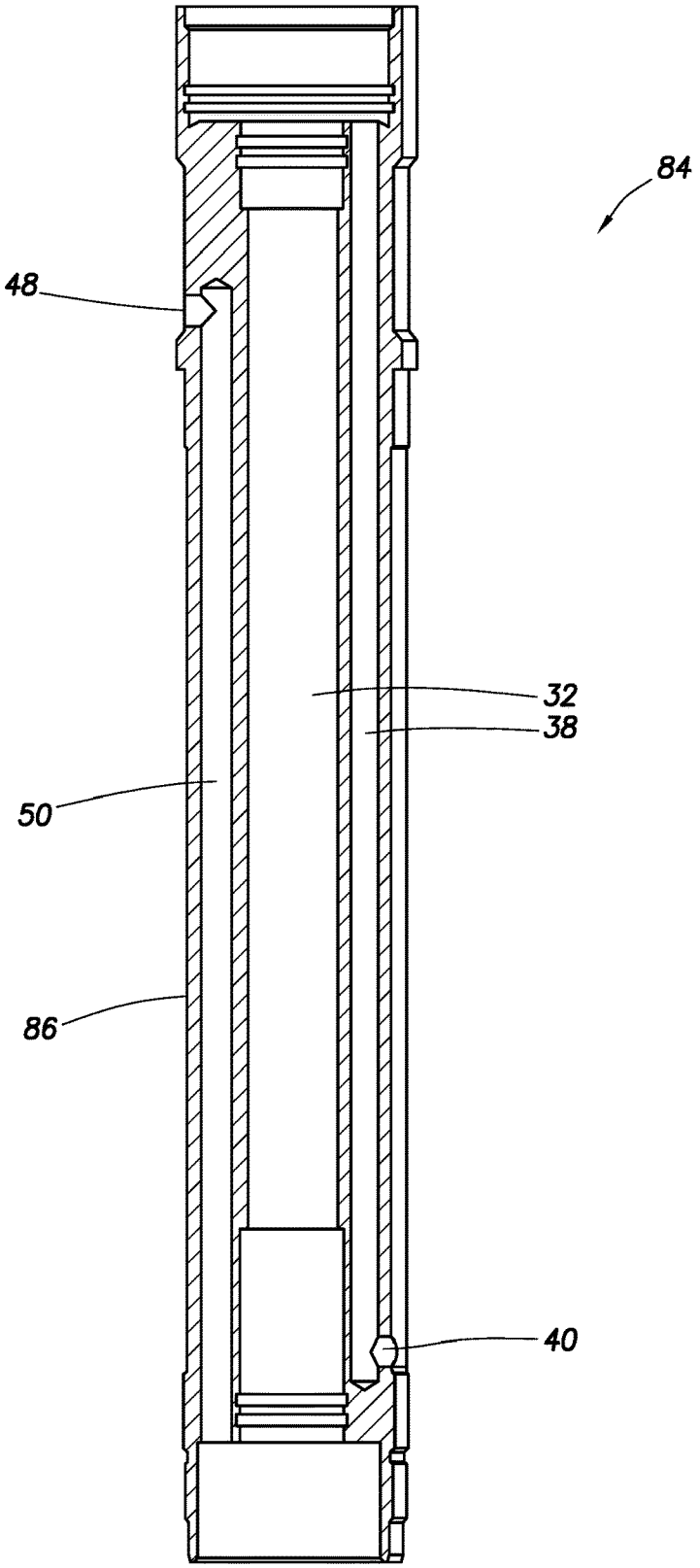
FIG. 10 is a representative cross-sectional view of the three-way sub, taken along line 10-10 of FIG. 11.

Referring additionally now to FIGS. 9-11, a three-way sub 84 portion of the manifold 80 is representatively illustrated. The term "three-way" indicates that all of the flow passages 32, 38, 50 are formed in the sub 84 example depicted in FIGS. 9-11. However, in other examples a sub of the manifold 80 could have any number of flow passages formed therein, in keeping with the principles of this disclosure.

As depicted in FIGS. 9-11, the flow passages 32, 38, 50 are formed at least partially in a generally tubular housing 86 having threaded and sealed connections at each end thereof. The flow passage 32 extends completely through the housing 86. The flow passages 38, 50 extend only partially through the housing 86.

Note that, in the FIGS. 9-11 example, there are actually multiple flow passages 38 and multiple flow passages 50. The flow passages 38, 50 are distributed circumferentially about the central flow passage 32.

Four of the flow passages 38 and eight of the flow passages 50 are depicted for the FIGS. 9-11 example, but in other examples there could be any number of the flow passages, and the flow passages 32, 38, 50 could be otherwise arranged (for example, the flow passages 38, 50 unevenly distributed about the flow passage 32, or with multiple flow passages 32). Thus, the scope of this disclosure is not limited in any way to the details of the three-way sub 84 as depicted in the drawings or described herein.

Figure 12:
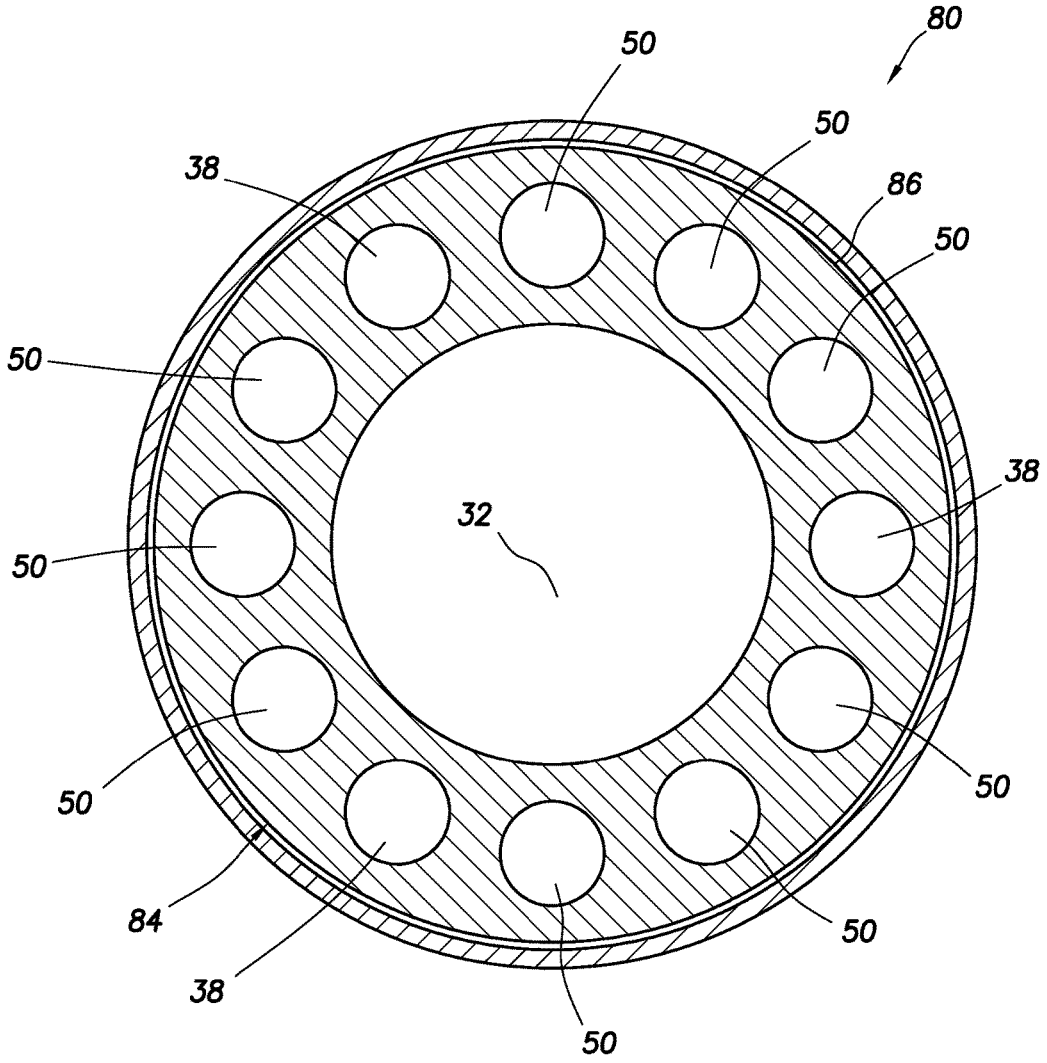
FIG. 12 is a representative lateral cross-sectional view of the manifold, taken along line 12-12 of FIG. 8.

The manner in which all of the flow passages 32, 38, 50 intersect a same lateral cross-section of the manifold 80 can be more clearly viewed in FIG. 12. The FIG. 12 example also depicts another arrangement of the flow passages 38, 50, in which there are three of the flow passages 38 and nine of the flow passages 50.

In other examples, the flow passages 38, 50 may not comprise longitudinal drilled "holes" distributed circumferentially about the flow passage 32. For example, concentric tubes could be used to isolate the flow passages 32, 38, 50 from each other in the three-way sub 84, with any number of the flow passages comprising annuli between the concentric tubes. Again, the scope of this disclosure is not limited in any way to the details of the three-way sub 84 as depicted in the drawings or described herein.

It may now be fully appreciated that the above disclosure provides significant advancements to the arts of constructing and operating systems and methods for gravel packing wellbores. In examples described above, the system 10 and associated method provide for enhanced convenience and reduced costs in gravel packing operations.

The above disclosure provides to the art a gravel pack system 10. In one example, the gravel pack system 10 can include a manifold 80 reciprocably received in a well completion assembly 16. The manifold 80 has at least first, second and third flow passages 32, 38, 50. The first, second and third flow passages 32, 38, 50 are isolated from each other in the manifold 80.

Each of the first, second and third flow passages 32, 38, 50 intersects a same lateral cross-section of the manifold 80. The second and third passages 38, 50 may be arranged about the first flow passage 32 in the lateral cross-section.

The first flow passage 32 extends longitudinally through the manifold 80. The second flow passage 38 is in communication with an exterior of the manifold 80 via a first port 40. The third flow passage 50 is in communication with the exterior of the manifold 80 via a second port 48.

The first and second ports 40, 48 are on opposite longitudinal sides of the lateral cross-section (e.g., line 12-12 of FIG. 8). The first port 40 can be isolated from the second port 48 by a first annular seal 44 carried on the manifold 80.

The second flow passage 38 is in communication with the exterior of the manifold 80 via a third port 54. The second port 48 is disposed longitudinally between the first and third ports 40, 54. The second port 48 can be isolated from the third port 54 by a second annular seal 52 carried on the manifold 80.

The manifold 80 is sealingly received in a seal bore 46 of the well completion assembly 16. The well completion assembly 16 includes a packer 20 that isolates a first well annulus 22 from a second well annulus 24. The second flow passage 38 provides fluid communication between the first annulus 22 and the second annulus 24 in a first position of the manifold 80 relative to the seal bore 46.

The first annulus 22 is isolated from the second annulus 24 and the third flow passage 50 in a second position of the manifold 80 relative to the seal bore 46. The first flow passage 32 is in communication with the second annulus 24 in the second position of the manifold 80 relative to the seal bore 46.

The well completion assembly 16 includes a well screen 26 in the second annulus 24. The third flow passage 50 provides fluid communication between the first annulus 22 and an interior of the well screen 26 in a third position of the manifold 80 relative to the seal bore 46.

A method of gravel packing a wellbore 12 is also provided to the art by the above disclosure. In one example, the method can comprise displacing a generally tubular service string 18 relative to a seal bore 46 in a well completion assembly 16, thereby selectively permitting and preventing flow through first and second ports 40, 48 that provide communication with an exterior of a manifold 80.

The manifold 80 includes first, second and third flow passages 32, 38, 50. The first port 40 provides communication between the second flow passage 38 and the exterior of the manifold 80, and the second port 48 provides communication between the third flow passage 50 and the exterior of the manifold 80.

In a first position of the service string 18 relative to the seal bore 46, the second flow passage 38 is in communication with a first well annulus 22 via a third port 54 providing communication with the exterior of the manifold 80, and the second flow passage 38 is in communication with a second well annulus 24 via the first port 40. The first annulus 22 and the second annulus 24 are isolated from each other by a packer 20 of the well completion assembly 16. The second port 48 is in the seal bore 46 and disposed longitudinally between the first and third ports 40, 54.

The displacing step may comprise displacing the service string 18 to a second position relative to the seal bore 46, thereby preventing flow through the first and second ports 40, 48. The first flow passage 32 is in communication with the second annulus 24 in the second position of the service string 18.

The displacing step may also comprise displacing the service string 18 to a third position relative to the seal bore 46, thereby permitting flow between the third flow passage 50 and the first annulus 22 via the second port 48. The first flow passage 32 is in communication with the second annulus 24 in the third position of the service string 18.

The method can include flowing a gravel slurry 64 through the first flow passage 50 and into the second annulus 24, thereby depositing gravel 28 about a well screen 26 of the well completion assembly 16. The method can also include a fluid 66 portion of the gravel slurry 64 flowing into the well screen 26 and to the first annulus 22 through the third flow passage 50.

The method can include forming the first, second and third flow passages 32, 38, 50 in a same lateral cross-section of the manifold 80.

The method can include blocking flow through the first flow passage 32 and then permitting communication between the first and third flow passages 32, 50. The method may include, after permitting communication between the first and third flow passages 32, 50, flowing a treatment fluid 76 through the first flow passage 32 to the third flow passage 50 and into a well screen 26 of the well completion assembly 16.

Another gravel pack system 10 example described above can include a manifold 80 reciprocably received in a well completion assembly 16. The manifold 80 has at least first, second and third longitudinally extending flow passages 32, 38, 50, and first, second, third, fourth and fifth successive contiguous longitudinal sections A-E.

In the first section A, the first and second flow passages 32, 38 are isolated from each other and from an exterior of the manifold 80, and the third flow passage 50 may not be present. In the second section B, the first and second flow passages 32, 38 are isolated from each other and from the exterior of the manifold 80, and the third flow passage 50 is in communication with the exterior of the manifold 80. In the third section C, the first, second and third flow passages 32, 38, 50 are isolated from each other and from the exterior of the manifold 80. In the fourth section D, the first and third flow passages 32, 50 are isolated from each other and from the exterior of the manifold 80, and the second flow passage 38 is in communication with the exterior of the manifold 80. In the fifth section E, the first and third flow passages 32, 50 are isolated from each other and from the exterior of the manifold 80, and the second flow passage 38 may not be present.

The first flow passage 32 extends longitudinally through the manifold 80, the second flow passage 38 is in communication with the exterior of the manifold 80 via a first port 40, and the third flow passage 50 is in communication with the exterior of the manifold 80 via a second port 48. The first port 40 can be isolated from the second port 48 by an annular seal 44 carried on the manifold 80.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A gravel pack system, comprising:

a manifold reciprocably received in a well completion assembly, the manifold having at least first, second and third flow passages, the first, second and third flow passages being isolated from each other in the manifold, and wherein each of the first, second and third flow passages intersects a single lateral planar cross-section of the manifold.

2. The gravel pack system of claim 1, wherein the first flow passage extends longitudinally through the manifold, the second flow passage is in communication with an exterior of the manifold via a first port, the third flow passage is in communication with the exterior of the manifold via a second port, and the first and second ports are on opposite longitudinal sides of the lateral cross-section.

3. The gravel pack system of claim 1, wherein the first flow passage extends longitudinally through the manifold, the second flow passage is in communication with an exterior of the manifold via a first port, the third flow passage is in communication with the exterior of the manifold via a second port, and the first port is isolated from the second port by a first annular seal carried on the manifold.

4. The gravel pack system of claim 3, wherein the second flow passage is in communication with the exterior of the manifold via a third port, the second port being disposed longitudinally between the first and third ports.

5. The gravel pack system of claim 4, wherein the second port is isolated from the third port by a second annular seal carried on the manifold.

6. The gravel pack system of claim 1, wherein the manifold is sealingly received in a seal bore of the well completion assembly.

7. The gravel pack system of claim 6, wherein the well completion assembly includes a packer that isolates a first well annulus from a second well annulus, and wherein the second flow passage provides fluid communication between the first annulus and the second annulus in a first position of the manifold relative to the seal bore.

8. The gravel pack system of claim 7, wherein the first annulus is isolated from the second annulus and the third flow passage in a second position of the manifold relative to the seal bore.

9. The gravel pack system of claim 8, wherein the first flow passage is in communication with the second annulus in the second position of the manifold relative to the seal bore.

10. The gravel pack system of claim 8, wherein the well completion assembly includes a well screen in the second annulus, and wherein the third flow passage provides fluid communication between the first annulus and an interior of the well screen in a third position of the manifold relative to the seal bore.

11. The gravel pack system of claim 1, wherein the second and third passages are arranged about the first flow passage in the lateral cross-section.

12. A method of gravel packing a wellbore, the method comprising:

displacing a generally tubular service string relative to a seal bore in a well completion assembly, thereby selectively permitting and preventing flow through first and second ports that provide communication with an exterior of a manifold, the manifold including first, second and third flow passages, the first port providing communication between the second flow passage and the exterior of the manifold, and the second port providing communication between the third flow passage and the exterior of the manifold, and in a first position of the service string relative to the seal bore, the second flow passage is in communication with a first well annulus via a third port providing communication with the exterior of the manifold, and the second flow passage is in communication with a second well annulus via the first port, the first annulus and the second annulus being isolated from each other by a packer of the well completion assembly, and the second port being in the seal bore and disposed longitudinally between the first and third ports.

13. The method of claim 12, wherein the displacing comprises displacing the service string to a second position relative to the seal bore, thereby preventing flow through the first and second ports.

14. The method of claim 13, wherein the first flow passage is in communication with the second annulus in the second position of the service string.

15. The method of claim 13, wherein the displacing comprises displacing the service string to a third position relative to the seal bore, thereby permitting flow between the third flow passage and the first annulus via the second port.

16. The method of claim 15, wherein the first flow passage is in communication with the second annulus in the third position of the service string.

17. The method of claim 16, further comprising flowing a gravel slurry through the first flow passage and into the second annulus, thereby depositing gravel about a well screen of the well completion assembly.

18. The method of claim 17, further comprising a fluid portion of the gravel slurry flowing into the well screen and to the first annulus through the third flow passage.

19. The method of claim 12, further comprising forming the first, second and third flow passages in a same lateral cross-section of the manifold.

20. The method of claim 12, further comprising blocking flow through the first flow passage and then permitting communication between the first and third flow passages.

21. The method of claim 20, further comprising, after permitting communication between the first and third flow passages, flowing a treatment fluid through the first flow passage to the third flow passage and into a well screen of the well completion assembly.

22. A gravel pack system, comprising:

a manifold reciprocably received in a well completion assembly, the manifold having at least first, second and third longitudinally extending flow passages, and first, second, third, fourth and fifth successive contiguous longitudinal sections, in the first section, the first and second flow passages are isolated from each other and from an exterior of the manifold, in the second section, the first and second flow passages are isolated from each other and from the exterior of the manifold, and the third flow passage is in communication with the exterior of the manifold, in the third section, the first, second and third flow passages are isolated from each other and from the exterior of the manifold, in the fourth section, the first and third flow passages are isolated from each other and from the exterior of the manifold, and the second flow passage is in communication with the exterior of the manifold, and in the fifth section, the first and third flow passages are isolated from each other and from the exterior of the manifold.

23. The gravel pack system of claim 22, wherein the first flow passage extends longitudinally through the manifold, the second flow passage is in communication with the exterior of the manifold via a first port, and the third flow passage is in communication with the exterior of the manifold via a second port.

24. The gravel pack system of claim 22, wherein the first flow passage extends longitudinally through the manifold, the second flow passage is in communication with the exterior of the manifold via a first port, the third flow passage is in communication with the exterior of the manifold via a second port, and the first port is isolated from the second port by a first annular seal carried on the manifold.

25. The gravel pack system of claim 24, wherein the second flow passage is in communication with the exterior of the manifold via a third port, the second port being disposed longitudinally between the first and third ports.

26. The gravel pack system of claim 25, wherein the second port is isolated from the third port by a second annular seal carried on the manifold.

27. The gravel pack system of claim 22, wherein the manifold is sealingly received in a seal bore of the well completion assembly.

28. The gravel pack system of claim 27, wherein the well completion assembly includes a packer that isolates a first well annulus from a second well annulus, and wherein the second flow passage provides fluid communication between the first annulus and the second annulus in a first position of the manifold relative to the seal bore.

29. The gravel pack system of claim 28, wherein the first annulus is isolated from the second annulus and the third flow passage in a second position of the manifold relative to the seal bore.

30. The gravel pack system of claim 29, wherein the first flow passage is in communication with the second annulus in the second position of the manifold relative to the seal bore.

31. The gravel pack system of claim 29, wherein the well completion assembly includes a well screen in the second annulus, and wherein the third flow passage provides fluid communication between the first annulus and an interior of the well screen in a third position of the manifold relative to the seal bore.

32. The gravel pack system of claim 22, wherein the third flow passage is nonexistent in the first section.

33. The gravel pack system of claim 22, wherein the second flow passage is nonexistent in the fifth section.

* * * * *